US007049912B2

(12) United States Patent
Bataille et al.

(10) Patent No.: US 7,049,912 B2
(45) Date of Patent: May 23, 2006

(54) ELECTRICAL DEVICE COMPRISING A CONTROLLED PIEZOELECTRIC ACTUATOR

(75) Inventors: Christian Bataille, Montigny-le-Bretonneux (FR); Stephane Follic, Le Plessis-Bouchard (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 10/501,341

(22) PCT Filed: Mar. 10, 2003

(86) PCT No.: PCT/FR03/00759

§ 371 (c)(1),
(2), (4) Date: Jul. 26, 2004

(87) PCT Pub. No.: WO03/079387

PCT Pub. Date: Sep. 25, 2003

(65) Prior Publication Data

US 2005/0104699 A1 May 19, 2005

(30) Foreign Application Priority Data

Mar. 19, 2002 (FR) ..... 02 03522

(51) Int. Cl.
*H01H 67/02* (2006.01)

(52) U.S. Cl. ..... 335/132; 310/314; 310/328

(58) Field of Classification Search ..... 310/311, 310/314, 317–319, 328; 335/132
See application file for complete search history.

(56) References Cited

U.S. PATENT DOCUMENTS

| | | | | |
|---|---|---|---|---|
| 4,383,195 | A * | 5/1983 | Kolm et al. | 310/330 |
| 4,473,859 | A * | 9/1984 | Stone et al. | 361/99 |
| 4,595,855 | A * | 6/1986 | Farrall | 310/332 |
| 6,359,374 | B1 * | 3/2002 | Dausch et al. | 310/330 |
| 2002/0135447 | A1 * | 9/2002 | Gruner | 335/132 |

FOREIGN PATENT DOCUMENTS

| | | |
|---|---|---|
| DE | 198 13 128 | 9/1999 |
| JP | 10 241481 | 9/1998 |

* cited by examiner

*Primary Examiner*—Lincoln Donovan
(74) *Attorney, Agent, or Firm*—Oblon, Spivak, McClelland, Maier & Neustadt, P.C.

(57) ABSTRACT

An electric switching device of which each power pole includes a movable bridge equipped with at least one movable contact that co-operates with at least one fixed contact of the pole between open and closed positions. The switching device includes at least one approach actuator—bistable or of Voice Coil type—acting on the movable bridges to distance and bring together the movable contacts of the movable bridges and the fixed contacts. Each pole includes a force actuator, e.g., piezoelectric, to establish contact pressure or contact switching, without the use of a mechanical restoring device.

28 Claims, 2 Drawing Sheets

FIG. 4
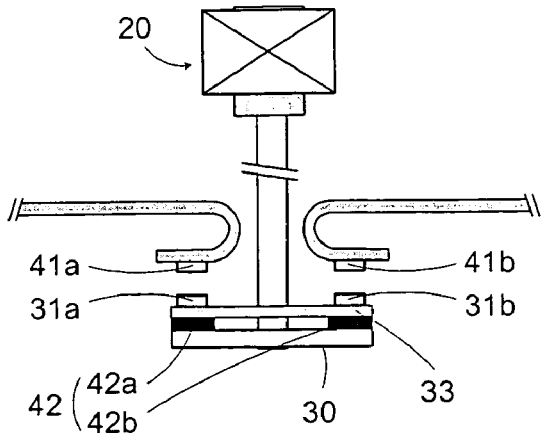
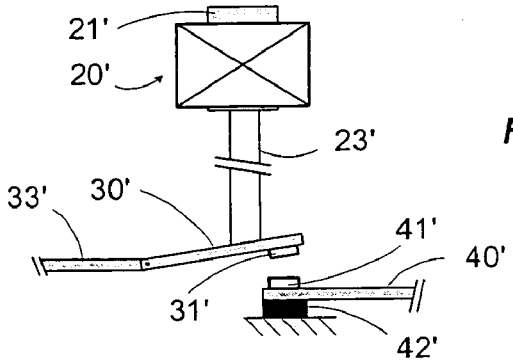
FIG. 5
FIG. 6
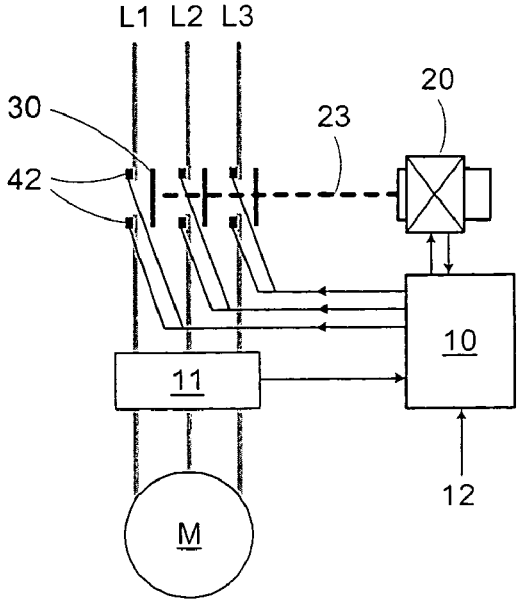

ELECTRICAL DEVICE COMPRISING A CONTROLLED PIEZOELECTRIC ACTUATOR

CROSS-REFERENCE TO RELATED APPLICATIONS

This application is a national stage application of the PCT application PCT/FR03/00759 filed on Mar. 10, 2003, which claims priority to French Patent Application No. 02/03522, filed on Mar. 19, 2002.

BACKGROUND OF THE INVENTION (1) Field of the Invention

The invention relates to an electric power switching device, monopolar or multipolar, of relay, contactor or contactor breaker type, whose closing and opening movements between moving contacts and stationary contacts are carried out via an approach actuator and a force actuator. The invention also relates to a closing and opening method of the contacts of such a switching device.

(2) Description of the Related Art

An electric switching device of relay type, contactor or contactor breaker is a device usually employed to perform the electric switching or commutation of a power charge, for example a motor. For this, it usually has, for each power pole, a movable bridge driven by an actuator generally constituted of an electromagnet common to the different poles and equipped with restoring means such as a return spring. The movable bridge has a single switching movable contact, or two double switching movable contacts, co-operating with one, respectively two, fixed contact(s), so as to break or make the flow of electric current in the power poles. Moreover, to obtain sufficient contact pressure, we usually employ pressure contact springs acting on the movable contacts.

The actuator can be controlled via a manual command by an operator or via a command sent by an automatic control. The moment that these commands appear is of course then out of sync with the intensity of current flowing in the different power poles of the switching device at this moment. Therefore, at the time of the opening movement corresponding to the separating of the fixed and movable contacts, a significant electric current could be circulating in the poles thus creating, in a continuous manner, an electric switching arc between the fixed and movable contacts. This switching arc requires an arc extinguishing chamber in the device and eventually accelerates the wear of the contact tips deposited on the fixed and movable contacts. To limit this inconvenience, the electromagnet has usually restoring means, such as a return spring, sufficiently significant to have the quickest possible separation between the fixed and movable contacts. However, at the time of the reverse closing movement corresponding to the bringing together of the fixed and movable contacts, this return force must be overcome which requires the increasing in size and strength of this electromagnet.

BRIEF SUMMARY OF THE INVENTION

A first purpose of the invention is to ensure the switching between the fixed and movable contacts of the poles of a switching device at the moment the alternating electric current circulating in these poles is practically nil. We thus reduce the electric arc generated at the moment of switching which advantageously reduces the wear of the contact tips.

This also results in a reduction in external manifestations due to switching and a simplification of the arc extinguishing chamber.

A second purpose of the invention is to remove the mechanical restoring means present in such a switching device. This allows to advantageously reduce the size of the actuators for a given nominal current. We thus obtain a switching device of reduced size and of simpler design that consumes less energy and whose contacts wear less quickly.

To do this, the invention describes an electric switching device for switching-on and switching-off a charge and comprising one or several power poles, each pole comprising a movable bridge equipped with at least one movable contact which co-operates with at least one fixed contact of the pole between opened and closed positions. The switching device comprises an approach actuator acting on the movable bridge(s) of the switching device so as to allow to distance and bring together the movable and fixed contacts. Each pole comprises a force actuator allowing to establish the contact pressure and the contact disconnection between the movable contact(s) and the fixed contact(s) of the pole, without the use of mechanical restoring means.

According to a feature, the approach actuator is constituted of an electrically controlled electromagnetic linear actuator or a Voice Coil type actuator.

According to another feature, the force actuator of a pole has at least one piezoelectric element acting on the fixed contact(s) of the pole.

According to another feature, the switching device comprises means for measuring the current circulating in the pole(s) linked to an electronic control unit capable of controlling the position of the approach actuator(s) and the force actuator(s). Thanks to the means for determining a position, this control unit allows a better management of the dynamic range (position, speed, force) for optimum operating of the switching device: suppression of bounce, contact pressure regulated according to the current circulating in the pole, diagnostic of wear on the tips.

The invention also relates to a method of switching a pole in an electric switching device. The method is characterised in that the closing movement of the contacts comprises an approach step allowing the movable bridge to approach the fixed contact(s) via an approach actuator and comprises a connecting step allowing to establish a contact pressure between the movable and fixed contacts of the pole via a force actuator. The method is also characterised in that the opening movement of the contacts comprises a disconnecting step allowing to separate the movable and fixed contacts of the pole via a force actuator and comprises a distancing step of the movable bridge via an approach actuator. To avoid the presence of electric arcs at the pole, the disconnecting step is only performed when the electric current circulating in the pole is less than a pre-set threshold, just prior to the current reaching zero.

BRIEF DESCRIPTION OF THE SEVERAL VIEWS OF THE DRAWINGS

Other features and advantages will appear in the following detailed description in reference to an embodiment given by way of illustration and represented by the annexed drawings in which:

FIG. 4 represents a second embodiment of a double switching contact pole;

FIG. 5 represents an embodiment of a single switching contact pole;

FIG. 6 details a block diagram of the controlling of the actuators of a switching device according to the invention.

DETAILED DESCRIPTION OF THE INVENTION

An electric power switching device, of relay, contactor or contactor breaker type, comprises one or several power poles. It is responsible for electrically controlling an electric charge, such as a motor, a resistance or other. In the example in FIG. 6, the switching device comprises three power poles corresponding to the three phases L1, L2, L3 of an alternative current, in order to control a motor M.

Figure 1:
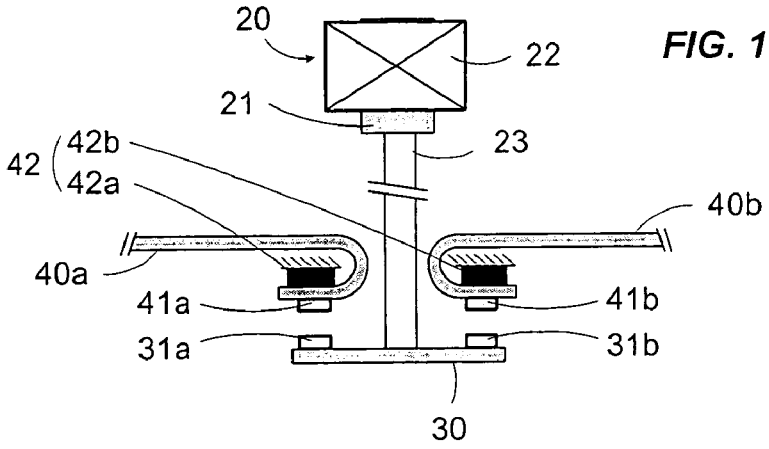
FIG. 1 represents a simplified embodiment of a double switching contact pole in a switching device according to the invention, in the open position.
Figure 2:
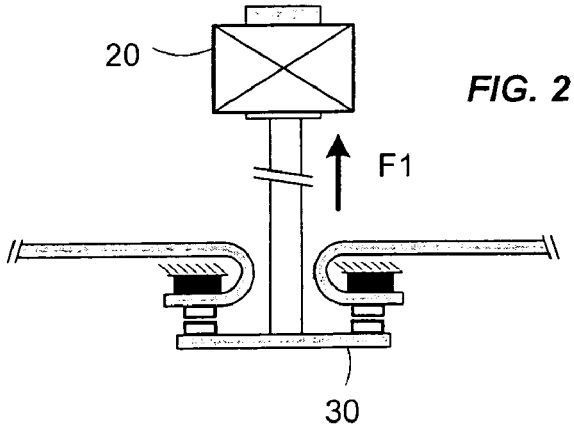
FIG. 2 shows the example of FIG. 1 after the approach step.
Figure 3:
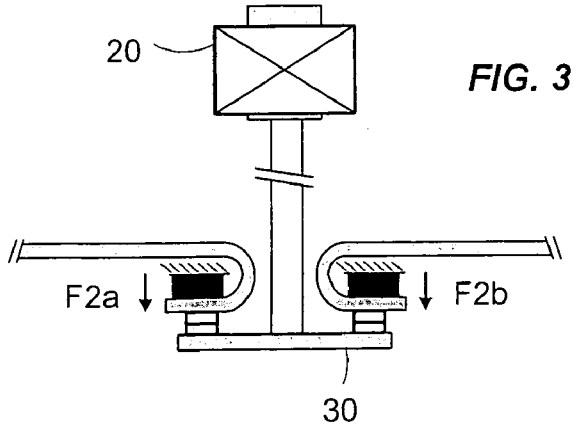
FIG. 3 shows the example of FIG. 1 in the closed position.

In reference to FIGS. 1 to 3, a power pole has a movable bridge 30 which has two movable contacts 31*a* and 31*b*, electrically linked together. The pole comprises two power conductors 40*a* and 40*b*, the conductor 40*a* corresponding, for example, to an upstream conductor and the conductor 40*b* corresponding to a downstream conductor of the switching device. These two conductors 40*a* and 40*b* each have at their end a fixed contact respectively 41*a* and 41*b* which comes into contact with one of the movable contacts 31*a* and 31*b* when the movable bridge 30 is in a closed position allowing an electric current to circulate between the upstream 40*a* and downstream 40*b* conductors. It is known that the end of the upstream 40*a* and downstream 40*b* conductors can create a loop so as to reduce the repulsion of contacts in the case of high current.

The movable bridge 30 is integral to a mechanical element 23, such as a finger, a push button or other, which itself is mechanically driven by the movable part 21 of an approach actuator 20. The features of such a mechanical link are standard in contactors or contactor breakers and are therefore not represented in the figures in this document. The approach actuator 20 is responsible for performing the movements of the approach stroke and the distancing stroke of the movable bridge, between the open position (see FIG. 1) and an intermediary position (see FIG. 2) where the fixed contacts 41*a* and 41*b* and the movable contacts 31*a* and 31*b* are close but separate from each other, as detailed below.

Each power pole also comprises a force actuator 42, responsible for performing the movements of the compression stroke of the contacts, that meaning responsible for establishing the contact pressure or switching between the fixed contacts 41*a* and 41*b* and the movable contacts 31*a* and 31*b* of the pole, between the intermediary position (see FIG. 2) and the closed position (see FIG. 3), as detailed below. According to a feature of the invention, the force actuator 42 is constituted of one or several deformable piezoelectric elements 42*a*, 42*b* and 42'.

The piezoelectric elements are already known of and have the specificity of deforming and slightly increasing in volume, when subject to a potential. This deformation is proportional to the value of the potential applied to them and is reversible when the potential disappears. Such elements are thus bistable and do not require any mechanical restoring means to return to the initial position. They have the advantage of consuming very little current, but nevertheless engendering an elevated force when increasing in volume in a very short response time. Moreover, they avoid using moving parts and therefore do not engender any wear.

In a first alternative represented in FIGS. 1 to 3, a power pole comprises two piezoelectric elements 42*a*, respectively 42*b*, placed between a fixed base of the switching device and the end of the power conductors 40*a*, respectively 40*b*, bearing the two fixed contacts 41*a*, respectively 41*b*. If a potential is applied to them, the piezoelectric elements 42*a* and 42*b* will increase in volume thus creating forces F2*a* and F2*b* (see FIG. 3) which will provoke a slight deformation of the loop created by the metallic conductors 40*a* and 40*b* and therefore a displacement of the fixed contacts 41*a* and 41*b* towards the movable contacts 31*a* and 31*b*. If the movable bridge 30 is in the intermediary position as in FIG. 2, this displacement will be sufficient for the fixed contacts 41*a* and 41*b* to touch and exercise pressure against the movable contacts 31*a* and 31*b* resulting in the closed position as in FIG. 3. Typically, the provoked displacement is approximately less than or equal to 1 mm. When the potential applied to the piezoelectric elements 42*a* and 42*b* disappears, they return to their initial shape which engenders a removal of the forces F2*a* and F2*b* and therefore a separating of the fixed and movable contacts and a return to the intermediary position as in FIG. 2.

In a second alternative represented in FIG. 4, the piezoelectric elements 42*a* and 42*b* are positioned on the movable bridge 30 and act on the movable contacts 31*a* and 31*b*. The movable bridge 30 can comprise a metallic conductor 33 linking the movable contacts 31*a* and 31*b* together. This conductor 33 is sufficiently flexible so that, when a potential is applied to the piezoelectric elements 42*a* and 42*b*, their increase in volume can generate a slight deformation of the conductor 33 and therefore a movement of the movable contacts 31*a* and 31*b* towards the fixed contacts 41*a* and 41*b*. However, this alternative results in an increase in the total weight of the movable bridge 30.

Preferably, the switching device comprises a single approach actuator 20 for all the poles. The movable part 21 of this actuator 20 thus drives all of the mechanical elements 23 of the different poles. According to another embodiment, the switching device can have a distinct approach actuator 20 for each pole. This second solution will be easier to employ as each pole can thus be individually controlled by smaller actuators, even though it can be of greater encumbrance.

The approach actuator 20 is an electrically controlled electromagnetic actuator, for example a bistable linear electromagnet. In this case, the movable part of the actuator is a movable core 21, such as an adjustable core made in a magnetic material, surrounded with a fixed casing 22 bearing a winding traversed by a control current. The approach actuator 20 acts on the movable bridges 30 (or on the movable bridge 30 if there is an approach actuator per pole or if the switching device only has one pole), so as to allow the distancing and bringing together of the fixed and movable contacts. When the winding of the fixed casing 22 receives a distancing command, the movable core 21 moves to a distancing position, corresponding to the open position of the pole contacts as is represented in FIG. 1. When the winding of the fixed casing 22 is traversed by a control current corresponding to the approach command, this engenders an electromagnetic force F1 on the movable core 21 which then moves to an approach position, corresponding to the intermediary position of the pole contacts as is represented in FIG. 2. In this intermediary position, the fixed and movable contacts are close to each other but do not touch.

According to the invention, the approach actuator 20 can also be a linear actuator of Voice Coil type in which the movable core comprises a coil, traversed by a control current, which moves on the inside of a fixed support assembly comprising a permanent magnet. Indeed, such an actuator has a low response time and a beneficial very fast dynamic range in this application. Finally, we can also envisage a rotary electromagnet equipped with a standard mechanism allowing to transform a rotary movement into a linear movement.

Advantageously, the approach actuator 20 does not therefore need to use restoring means, of return spring type, to return the movable core 21 back to its initial pre-set position. The speed and position of the actuator 20 are regulated by a control unit 10 so as to obtain a fast approach stroke and a stable position. This position regulating is particularly important so as to maintain the movable bridge 30 in the closed position, as when the piezoelectric elements 42*a* and 42*b* generate the forces F2*a* and F2*b*, these forces F2*a* and F2*b* must be compensated by the force F1 generated by the approach actuator 20 so as to maintain correct pressure between the fixed and movable contacts.

In reference to FIG. 6, the switching device comprises an electronic control unit 10 which is equipped with a processing unit, such as a microprocessor or microcontroller, and a memory, and which is linked to means for measuring 11 the current of the switching device, such as current sensors, capable of delivering signals proportional to the currents circulating in the phases L1, L2 and L3. The control unit 10 also receives an external closing or opening drive command 12 which comes directly from either an operator command or from an automatic command for example. According to this information, the control unit 10 is capable of sending appropriate commands to the approach actuator 20 and to the force actuators 42 of the different poles.

Furthermore, the control unit 10 must be capable of knowing the position of the movable core 21 in real time so as to be able to regulate the speed and position of the positioning of the approach actuator 20. To do so, the control unit 10 comprises means for determining the position of the movable core 21. In the case of an approach actuator 20 of voice coil type bearing little reluctance variation, these means for determining the position comprise for example a sensor for the position of the movable core 21, returning position data to the control unit 10. In the case of an approach actuator 20 of bistable linear electromagnet type, the control unit 10 does not necessarily have a position sensor as it is capable of estimating this position of the movable core 21 from measurements of the potential and current circulating in the coil and from a calculation of the inductance variation linked to the gap variation, as indicated in the document FR0200952.

Starting from an initial situation where the contacts are in the open position, the commutating of a pole takes place according to the following method:

When the control unit 10 receives a drive command 12 ordering the closure of the contacts, the method of commutating a pole comprises an approach step in which the control unit 10 sends an approach command to the approach actuator 20. The electromagnetic force F1 thus generated provokes a displacement of the movable core 21 towards the intermediary position. The method of commutating a pole also comprises a connecting step in which the control unit 10 sends a force command to the force actuator 42 of the pole. Under the effects of this force command, the elements 42*a*, respectively 42*b*, of the force actuator 42 receive a potential generating an increase in their volume and creating a force F2*a*, respectively F2*b*, on the fixed contacts 41*a*, respectively 42*b*, sufficient to carry out the compression stroke of the contacts and bring the fixed contacts 41*a*, respectively 41*b*, into contact with the movable contacts 31*a*, respectively 31*b*. During this connecting step, as the forces F2*a*, F2*b* and the force F1 are in opposition, the control unit 10 must balance the different forces by regulating the position of the movable core 21 to stop it from moving due to the action of the forces F2*a* and F2*b* so as to ensure a satisfactory contact pressure. Equally, the approach step and the connecting step can take place sequentially or simultaneously.

In the transitory intermediate position, the fixed and movable contacts are thus sufficiently distanced so as to avoid the establishing of an electric current between them but are sufficiently close so that the small displacement provoked during the connecting step brings the fixed and movable contacts together.

Upon the closing of the contacts we can additionally create diagnostic functions for the wear of the contact tips, when there is an approach actuator per pole. When the approach actuator instigates a closure movement at a stable speed, we detect thanks to the current sensors 11 the moment when the current is established in the phase corresponding to the pole. By following the evolution of this instance through time, we are thus capable of knowing the wear evolution of the contact tips.

Inversely, starting from an initial situation where the contacts are in the closed position, the commutating of a pole takes place according to the following method:

When the control unit 10 receives a drive command 12 ordering the opening of the contacts, the method of commutating a pole firstly comprises a disconnecting step in which the control unit 10 deletes the force command sent to the force actuator 42 of the pole. The disappearance of the potential applied to the elements 42*a*, respectively 42*b*, of the force actuator 42 will engender a return to their initial shape, thus generating the separation of the fixed contacts 41*a*, respectively 41*b*, and the movable contacts 31*a*, respectively 31*b*, and their return to the intermediary position. Once this disconnecting step has been accomplished, the method of commutating a pole comprises a distancing step during which the control unit 10 sends a distancing command to the approach actuator 20. This distancing command provokes the displacement of the movable core 21 towards the distanced position, leading the movable bridge(s) 30 in order to attain the open position of the contacts.

Advantageously, the disconnecting step is independently performed pole by pole, at the exact moment the current reaches zero, that meaning when practically no current is circulating in the power poles. To do this, the control unit 10 uses the signals coming from the current sensors 11 and proportional to the currents circulating in the phases L1, L2 and L3. To delete the force command sent to the force actuator 42 of a pole, the control unit 10 checks that the intensity of the current circulating in the phase corresponding to this pole is less than a pre-set maximum threshold, almost zero. By thus controlling the near absence of current in the pole, we thus ensure that the separation of the fixed and movable contacts of this pole generates a very small or no electric arc. Given the phase difference between the currents of the switching device poles, the dropping of the current to zero is not simultaneous and the deleting of the force command on the different poles will therefore take place at distinct moments, which justifies the benefit of having distinct effort actuators for each pole. We can thus guarantee that the switching of the switching device contacts engenders very little or no electric switching arc. The distancing step is thus only instigated when the disconnecting step has taken effect on all the switching device poles.

Furthermore, the driving of the actuators by the control unit 10 has the advantage of being able to adapt the control level of the actuators according to the currents circulating in the phases. Is a high current, for example a high transitory current or an almost short-circuit current, is measured by the current sensors 11 in one or several phases, the control unit 10 is then capable of accentuating the force actuator controls and regulating the position of the approach actuator so as to maintain a correct contact pressure in the poles.

In the single switching alternative in FIG. 5, each pole of the switching device only has one movable contact 31' placed at one end of a movable bridge 30' and co-operating with a fixed contact 41' placed on a fixed conductor 40', for example downstream. The other end of the movable bridge 30' is articulated with a fixed conductor 33', for example upstream. A force actuator 42', of piezoelectric type, is placed between the fixed base of the switching device and the fixed conductor 40' so as to allow the establishment of the contact pressure between the fixed contact 41' and the movable contact 31', when a potential is applied to the piezoelectric element 42'. The movable bridge 30' is linked to the movable part 21' of an approach actuator 20' via a mechanical element 23'. The operating of this alternative is equivalent to the one previously described.

Of course, without leaving the framework of the invention, other alternatives and developments can be imagined and we can even envisage the use of equivalent means.

The invention claimed is:

1. An electric switching device comprising:

one or plural power poles, each pole comprising a movable bridge equipped with at least one movable contact configured to cooperate with at least one fixed contact of the pole between open and closed positions; and an approach actuator acting on each movable bridge of the switching device configured to approach and to distance each movable contact and each corresponding fixed contact;

wherein each pole comprises a force actuator configured to establish contact pressure between each moveable contact and each corresponding fixed contact, after the approach actuator has brought each moveable contact close to each corresponding fixed contact, and configured to disconnect each movable contact and each corresponding fixed contact, without use of a mechanical restoring device.

2. An electric device according to claim 1, wherein the approach actuator comprises an electrically controlled electromagnetic bistable linear actuator.

3. An electric device according to claim 1, wherein the approach actuator comprises a Voice Coil actuator.

4. An electric device according to claim 1, comprising a distinct approach actuator per pole configured to act on the movable bridge of each pole.

5. An electric device according to claim 1, wherein the force actuator comprises a piezoelectric element configured to act on each fixed contact of the pole.

6. An electric device according to claim 1, wherein the force actuator comprises a piezoelectric element configured to act on each movable contact of the movable bridge.

7. An electric device according to claim 1, further comprising means for measuring a current circulating in each power pole and linked to an electronic control unit configured to control a position of each approach actuator and the corresponding force actuator.

8. An electric device according to claim 7, wherein the electronic control unit comprises means for determining the position of the approach actuator to control the position of each approach actuator.

9. A method of closing a contact in an electric switching device according to claim 1, comprising:

approaching the movable bridge to each fixed contact by the approach actuator without making contact between the moveable bridge and each fixed contact; and connecting each moveable contact with each corresponding fixed contact, after said approaching, by establishing a contact pressure between each movable contact of the movable bridge and each corresponding fixed contact of the pole by the force actuator.

10. A method of opening a contact in an electric switching device according to claim 1, comprising:

disconnecting by separating the movable contact of the movable bridge from the fixed contact of the pole by the force actuator; and distancing, after said disconnecting, the movable bridge from the fixed contact by the approach actuator.

11. The method according to claim 10, wherein the disconnecting is performed when an electric current circulating in the pole is less than a pre-set threshold.

12. The electric switching device according to claim 1, wherein the approach actuator does not contact the movable contact with the fixed contact.

13. The electric switching device according to claim 1, wherein the force actuator comprises a piezoelectric element acting on the movable bridge so as to deform the moveable bridge to move the movable contact to the fixed contact.

14. An electric switching device comprising:

a pole comprising a movable contact, a fixed contact and a force actuator; and an approach actuator configured to move said movable contact relative to the fixed contact between an open position and an intermediate position, wherein said movable contact and said fixed contact are separate from each other in said open position and in said intermediate position;

wherein said force actuator is configured to displace at least one of said movable contact or said fixed contact from said intermediate position to a closed position, wherein said movable contact and said fixed contact are in contact with each other in said closed position, said force actuator being further configured to displace said at least one of said movable contact or said fixed contact from said closed position to said intermediate position.

15. The electric switching device according to claim 14, wherein said force actuator is configured to displace said at least one of said movable contact or said fixed contact from said closed position to said intermediate position without use of a mechanical restoring device.

16. The electric switching device according to claim 14, wherein said force actuator is configured to displace said at least one of said movable contact or said fixed contact from said intermediate position to a closed position without use of said approach actuator.

17. The electric switching device according to claim 16, wherein said force actuator is configured to displace said at least one of said movable contact or said fixed contact from said closed position to said intermediate position without use of said approach actuator.

18. The electric switching device according to claim 14, wherein said force actuator comprises a piezoelectric element.

19. The electric switching device according to claim 18, wherein said piezoelectric element is coupled to said fixed contact, wherein said piezoelectric element is configured to deform so as to displace said fixed contact between said intermediate position and said closed position.

20. The electric switching device according to claim 18, wherein said piezoelectric element is coupled to said movable contact, wherein said piezoelectric element is configured to deform so as to displace said movable contact between said intermediate position and said closed position.

21. The electric switching device according to claim 14, comprising a three of said poles, each of said poles comprising at least one of said movable contact, said fixed contact and said force actuator, each pole corresponding to a phase of an alternative current.

22. The electric switching device according to claim 14, wherein said force actuator comprises a bistable element, wherein said bistable element is configured to deform so as to displace said at least one of said fixed contact or movable contact between said intermediate position and said closed position.

23. The electric switching device according to claim 14, wherein said force actuator comprises an element that is subject to a deformation when a potential is applied to said element.

24. The electric switching device according to claim 14, wherein said pole comprises two movable contacts and two fixed contacts, each movable contact being configured to contact one of said fixed contact in said closed position.

25. The electric switching device according to claim 14, wherein a distance between said fixed contact and said movable contact in said intermediate position is less than or equal to 1 mm.

26. The electric switching device according to claim 14, further comprising a current measuring device configured to measure a current circulating in the pole and coupled to a control unit configured to control the approach actuator and the force actuator based on a measurement of said current measured with said current measuring device.

27. The electric device according to claim 26, wherein the control unit is configured to control said force actuator so that said force actuator displaces said at least one of said movable contact or said fixed contact from said closed position to said intermediate position when said current circulating in the pole is less than a pre-set threshold.

28. An electric switching device comprising:

a pole comprising a movable bridge, a movable contact, and a fixed contact, wherein the movable contact is fixed to the movable bridge and the movable contact is configured to cooperate with the fixed contact between open and closed positions; and an approach actuator configured to approach and to distance the movable contact relative to the fixed contact;

wherein the pole comprises a force actuator configured to establish contact pressure between the movable contact and the fixed contact, after the approach actuator has brought the movable contact close to the fixed contact, and configured to disconnect the movable contact and the fixed contact, without use of a mechanical restoring device.

* * * * *